United States Patent [19]

Sakai

[11] 4,310,610

[45] Jan. 12, 1982

[54] TWO COLOR ELECTROSTATOGRAPHIC PROCESS

[75] Inventor: Katsuo Sakai, Tokyo, Japan

[73] Assignee: Ricoh Company, Ltd., Tokyo, Japan

[21] Appl. No.: 33,316

[22] Filed: Apr. 25, 1979

[30] Foreign Application Priority Data

Apr. 27, 1978 [JP] Japan ..... 53/50664
May 10, 1978 [JP] Japan ..... 53/55789

[51] Int. Cl.[3] ..... G03G 13/01

[52] U.S. Cl. ..... 430/42; 430/55; 430/57

[58] Field of Search ..... 430/31, 42, 55, 57

[56] References Cited

U.S. PATENT DOCUMENTS

| | | | |
|---|---|---|---|
| 2,962,375 | 11/1960 | Schaffert | 430/57 |
| 2,987,395 | 6/1961 | Jarvis | 430/57 |
| 3,165,405 | 1/1965 | Hoesterey | 430/57 |
| 3,355,289 | 11/1967 | Hall et al. | 430/57 |
| 3,775,106 | 11/1973 | Tamai et al. | 96/1.2 |
| 3,795,513 | 3/1974 | Giuffini | 96/1 R |
| 3,844,783 | 10/1974 | Matsumoto et al. | 96/1.2 |
| 3,884,686 | 5/1975 | Bean | 96/1.2 X |
| 4,039,831 | 8/1977 | Lehmann | 96/1.2 X |
| 4,078,929 | 3/1978 | Gundlach | 96/1.2 |

*Primary Examiner*—Richard L. Schilling
*Assistant Examiner*—John L. Goodrow
*Attorney, Agent, or Firm*—David G. Alexander

[57] ABSTRACT

A photoconductive member (11) has a conductive substrate (11*a*) on which is formed a first photoconductive layer (11*b*) which is insensitive to red light but sensitive to at least one other color component of white light and a second photoconductive layer (11*c*) formed on the first layer (11*b*) which is sensitive to red light. A first electrostatic charge of a first polarity is formed at the interface between the first and second layers (11*b*), (11*c*). A second electrostatic charge of a second polarity is formed on the second layer (11*c*). A light image having black, white and red areas is radiated onto the second layer (11*c*). The white light causes both layers (11*b*), (11*c*) to conduct and dissipate all charge. The red light causes only the second layer (11*c*) to conduct to form a bipolar electrostatic image. Black toner which is electrostatically charged to the first polarity and red toner which is electrostatically charged to the second polarity are applied to the member (11) to form a bicolor toner image which is fixed to the member (11) or transferred to a copy sheet and fixed thereto. The magnitude of the second charge is sufficiently smaller than the magnitude of the first charge to allow formation of a bipolar elctrostatic image in which the positive and negative image areas have electrostatic potential magnitudes sufficient to constitute electrostatic images for electrostatography.

6 Claims, 12 Drawing Figures

TWO COLOR ELECTROSTATOGRAPHIC PROCESS

BACKGROUND OF THE INVENTION

The present invention relates to a two color electrostatographic or electrostatic copying process.

A novel and unique two color electrostatic copying process is disclosed in copending U.S. patent application Ser. No. 912,273, filed June 5, 1978, now U.S. Pat. No. 4,250,239 entitled "COLOR ELECTROSTATOGRAPHIC PROCESS AND MATERIAL FOR PRACTICING SAME," which is assigned to the same assignee as this application. The present invention constitutes improvements to the basic copying process which yet further improve the quality of two color copies produced thereby.

Color electrostatic copying machines which produce full color copies are known in the art. These are generally of two types. The first type comprises a single photoconductive drum or belt which is exposed to a light image of an original document three times through filters of three primary colors respectively. After each imaging operation, a toner substance of a corresponding color is applied to the drum to form a color toner image which is transferred to a copy sheet. In this manner, three color toner images are sequentially formed on the drum and transferred to the copy sheet in register to produce a color copy. Often, a fourth black toner image is formed and transferred to the copy sheet in register with the three color toner images.

In such a copy machine it is essential that the toner images be transferred to the copy sheet in perfect register. The control mechanism for such a copying machine is therefore intricate and expensive. The three or four imaging operations for each copy require a disproportionate amount of time, making the process very slow.

The second type of color copying machine is much faster in operation but also much more expensive to manufacture. Such a copying machine comprises three or four photoconductive drums or belts. The original document is passed over all of the drums in one scanning movement, sequentially imaging the drums through three respective primary color filters. A toner development unit is associated with each drum. The copy sheet is fed through the machine in one pass, with the toner images being transferred thereto in register through sequential engagement with the drums.

In addition to the increased cost of the three or four drums compared to only one drum or belt in the first type of color copying machine, an intricate mechanism is also required in the second type of copying machine to ensure perfect register of the three of four toner images on the copy sheet.

A full color copying machine is unnecessary in many business operations where only commercial documents are copied, since such documents generally only comprise the colors black and red, in addition to a white background. This is because accounting records and the like generally contain credit entries in black and debit entries in red. Since in many such documents the debit and credit entries may be distinguished from each other only by the color of ink, many offices have purchased or leased full color copying machines for copying such records. The full color copying capability is wasted since it is only necessary to distinguish red from black on the copies.

The basic process of the above indicated patent application overcomes the drawbacks of the prior art by providing a simple and low cost copying machine which can produce copies in two colors, such as red and black, using only one imaging operation and comprising only one photoconductive drum or belt. In the basic process, a photoconductive material comprises a conductive substrate, an inner photoconductive layer formed on the substrate and being sensitive to visible light and an outer photoconductive layer formed on the inner layer which is insensitive to red light. An electrostatic charge is applied to the outer layer while radiating the material with light to make only the inner layer conduct. Then, an electrostatic charge of the opposite polarity is applied to the outer layer in the dark. A light image of an original document is radiated onto the outer layer, white areas of the image causing photoconduction of both layers and red areas thereof causing photoconduction of only the inner layer. As a result, white areas of the material have zero surface potential while red and black areas have non-zero surface potentials of opposite respective polarities. Red and black toner particles of opposite electrostatic charge are applied to the material and adhere to the respective charged areas to form a red and black toner image which is transferred to a copy sheet.

A problem with the prior process is that the electrostatic image corresponding to the black image areas is predominated by the charge at the interface of the inner and outer layers whereas the electrostatic image corresponding to the red image areas is predominated by the charge at the surface of the outer layer. Thus, the resolution of the red image areas is higher than that of the black image areas. This is undesirable since most of the printing on business documents and the like is black rather than red, and the color which is used most should have the highest possible resolution rather than vice-versa.

SUMMARY OF THE INVENTION

A two color electrostatographic process embodying the present invention comprises the steps of providing a photoconductive member having an electrically conductive substrate, a first photoconductive layer formed on the substrate and a second photoconductive layer formed on the first layer, the first and second layers being formed in such a manner that light of a first color radiated onto the second layer renders the first and second layers photoconductive and light of a second color radiated onto the second layer renders only the second layer photoconductive, forming a first electrostatic charge of a first polarity at an interface between the first and second layers, forming a second electrostatic charge of a second polarity on the second layer and radiating a light image onto the second layer, the light image having a black image area and image areas of the first and second colors respectively, a magnitude of the second charge being smaller than a magnitude of the first charge to an extent such that an electrostatic potential on the second layer is substantially zero in the image area of the first color; of the second polarity and sufficient magnitude to constitute an electrostatic image for electrostatography in the black image area; and of the first polarity and sufficient magnitude to constitute an electrostatic image for electrostatography in the image area of the second color after performing the entire process.

In accordance with the present invention, a photoconductive member has a conductive substrate on which is formed a first photoconductive layer insensitive to red light but sensitive to at least one other color component of white light and a second photoconductive layer formed on the first layer which is sensitive to red light. A first electrostatic charge of a first polarity is formed at the interface between the first and second layers. A second electrostatic charge of a second polarity is formed on the second layer. A light image having black, white and red areas is radiated on the second layer. The white light causes both layers to conduct and dissipate all charge. The red light causes only the second layer to conduct to form a bipolar electrostatic image. Black toner electrostatically charged to the first polarity and red toner electrostatically charged to the second polarity are applied to the member to form a bicolor toner image which is fixed to the member or transferred to a copy sheet and fixed thereto. The magnitude of the second charge is sufficiently smaller than the magnitude of the first charge to allow formation of a bipolar electrostatic image in which the positive and negative image areas have electrostatic potential magnitudes sufficient to constitute electrostatic images for electrostatography.

It is an object of the present invention to provide a two color electrostatographic process which overcomes the drawbacks of the prior art and produces two color electrostatic copies of high quality.

It is another object of the present invention to provide a two color electrostatographic process which provides higher resolution for black image areas than has been obtainable in the prior art.

It is another object of the present invention to provide a two color electrostatographic process which may be practiced using apparatus which is simpler in construction and lower in cost than that which is required by the prior art.

It is another object of the present invention to provide a generally improved two color electrostatographic process.

Other objects, together with the foregoing, are attained in the embodiments described in the following description and illustrated in the accompanying drawing.

DESCRIPTION OF THE PREFERRED EMBODIMENTS

While the two color electrostatographic process of the present invention is susceptible of numerous physical embodiments, depending upon the environment and requirements of use, substantial numbers of the herein shown and described embodiments have been made, tested and used, and all have performed in an eminently satisfactory manner.

Figure 1A:
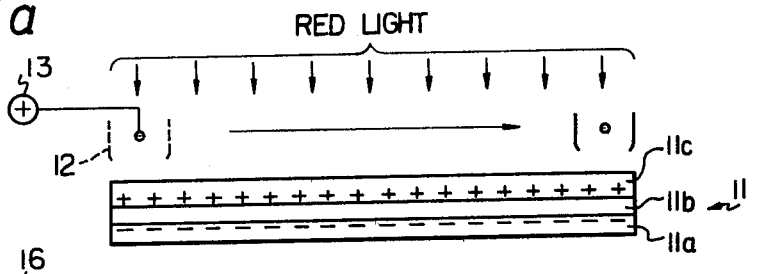
FIGS. 1*a* to 1*d* are diagrams illustrating a first electrostatographic process embodying the present invention.

Referring now to the drawing, a photoconductive member or material 11 of the present invention is illustrated in FIG. 1*a*. The material 11 may be in the form of a drum, belt or sheet, although only illustrated in cross section. The material 11 comprises an electrically conductive and grounded substrate 11*a* formed of metal or the like and an inner first photoconductive layer 11*b* formed on the substrate 11*a*. The layer 11*b* is insensitive to red light but sensitive to at least one other color component of white light.

In accordance with a unique feature of the present invention, a second outer photoconductive layer 11*c* is formed on the inner layer 11*b*. The outer layer 11*c* is at least partially optically transparent, and is sensitive to red light. Where it is desired to make copies in black and red, the inner layer 11*b* is insensitive to red, but rendered photoconductive by light of other colors, especially cyan and white (which contains cyan). Typically, the layer 11*b* is not rendered photoconductive by light having a wavelength greater than approximately 600 millimicrons. The red region begins at approximately 640 millimicrons, and therefore the inner layer 11*b* is insensitive to red light.

FIG. 1*a* illustrates the first steps of the process, which are performed simultaneously. A corona charging unit 12 applies a uniform positive electrostatic charge to the surface of the outer layer 11*c*, while red light is radiated thereonto. The unit 12 is powered by a positive D.C. source 13. Although not illustrated, white light may be radiated onto the surface of the outer layer 11*c* through a red filter. The red light causes no photoconduction in the inner layer 11*b*, but causes the outer layer 11*c* to conduct.

Thus, a positive electrostatic charge is formed at the interface of the layers 11*b* and 11*c*.

The positive charge at the interface of the layers 11*b* and 11*c* induces a negative charge on the lower surface of the layer 11*b*. More specifically, negative charges migrate through the substrate 11*a* to accumulate at the lower surface of the inner layer 11*b*.

The same effect may be produced by charging the layer 11*c* in the dark and subsequently radiating the same with red light. In this case, during the charging the positive charges will accumulate at the upper surface of the outer layer 11*c*. When the outer layer 11*c* is rendered photoconductive by the red light, the positive charges will migrate through the outer layer 11*c* to the interface of the layers 11*b* and 11*c*.

In either case, when radiation of the material 11 with red light is terminated, the outer layer 11*c* is no longer rendered photoconductive and the positive charges are trapped at the interface of the layers 11*b* and 11*c*.

Figure 1B:
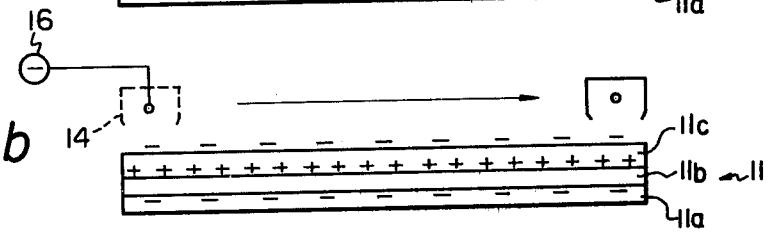

Next, as illustrated in FIG. 1*b*, a corona charging unit 14 applies a negative charge to the outer layer 11*c*. The unit 14 is powered by a negative D.C. source 16. The magnitude of the negative charge applied to the material 11 by the unit 14 is designed to be great enough to reverse the surface potential of the material 11, or change it from positive to negative. The magnitude of the negative charge applied by the charger 14 is smaller than the positive charge applied by the charger 12, as will be described in detail below.

The charge on the upper surface of the outer layer 11*c* is negative, and the net electrostatic potential at the surface of the material 11 is negative in spite of the effect of the larger trapped positive charge at the interface of the layers 11*b* and 11*c*.

Figure 1C:
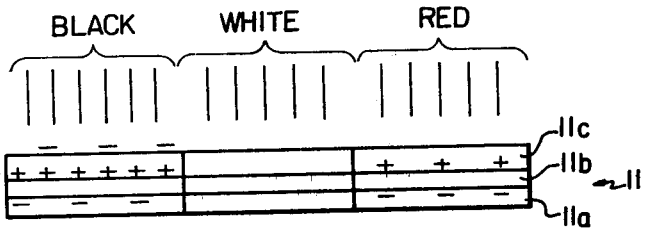

Next, a light image of an original document (not shown) is radiated onto the outer layer 11*c* as shown in FIG. 1*c*. It will be assumed that the light image consists of black, red and white image areas as labeled.

Since the black image area is void of visible light of any color, neither of the layers 11*b* and 11*c* is rendered photoconductive in this area. Thus, the surface potential of the member 11 remains negative in the black image area.

In the red image area, only the layer 11*c* is rendered photoconductive. The negative charge at the surface of the layer 11*c* neutralizes part of the positive charge at the interface of the layers 11*b* and 11*c*. The remaining positive charge at the interface of the layers 11*b* and 11*c* causes the surface potential of the member 11 to be reversed from negative to positive in the red image area.

The cyan component of the white area of the light image renders both layers 11*b* and 11*c* photoconductive. This has the effect of dissipating all charge in the member 11 in the white area of the light image.

As the result of these steps, the surface potential in the black area of the light image on the material 11 remains negative, as described above. The potential in the white image area in zero.

In the red image area, a positive charge remains at the interface of the layers 11*b* and 11*c*. An equal negative charge is induced at the lower surface of the layer 11*b*. However, the positive charge predominates at the surface of the material 11 in the red image area. Thus, the surface potential of the material 11 is negative in the black image area, positive in the red image area and zero in the white image area.

Figure 1D:
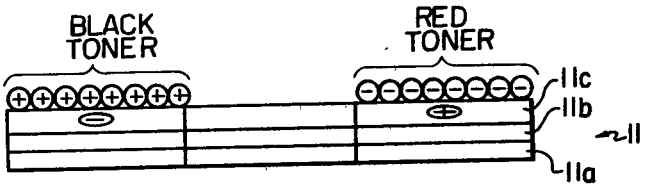

The thusly formed bipolar electrostatic image on the material 11 is developed through application of positively charged black toner and negatively charged red toner thereto, as shown in FIG. 1*d*. The black toner adheres to the negative area of the electrostatic image and the red toner adheres to the positive area of the electrostatic image. The red and black toners may be applied either simultaneously in the form of a mixture or sequentially in separate form. Step 1*d* results in the formation of a two color (red and black) toner image. The bipolar toner image may be fixed to the member 11 or transferred and fixed to a copy sheet, although not illustrated.

Although only one imaging step has been shown and described with reference to FIG. 1*c*, it will be understood that the light image may be radiated onto the material 11 twice; once through a red filter and once through a cyan filter. This improves the contrast of the copy. Radiation through the red filter causes photoconduction in only the layer 11*c*. Radiation through the cyan filter causes photoconduction in both the layers 11*b* and 11*c*.

In accordance with the present invention, other color combinations may be utilized other than red and black, for example red and another chromatic color. Charged toner particles of any colors may be used, as long as they are of the correct polarity, even if they do not correspond to the colors of the original document. The basic principle of the invention is to provide two photoconductive layers, one of which is sensitive to first and second colors and the other of which is sensitive to only the first color. In the present example, the first color is white (or the cyan component of white) and the second color is red. It is further within the scope of the present invention, where two chromatic colors are to be reproduced, to have one layer sensitive to one of the colors and the other layer sensitive to the other color. An electrostatic image comprising positive and negative areas as well as zero potential areas may be produced utilizing other combinations of stratified charge patterns and colors which are not specifically recited herein but which are within the scope of the present invention.

Figure 2:
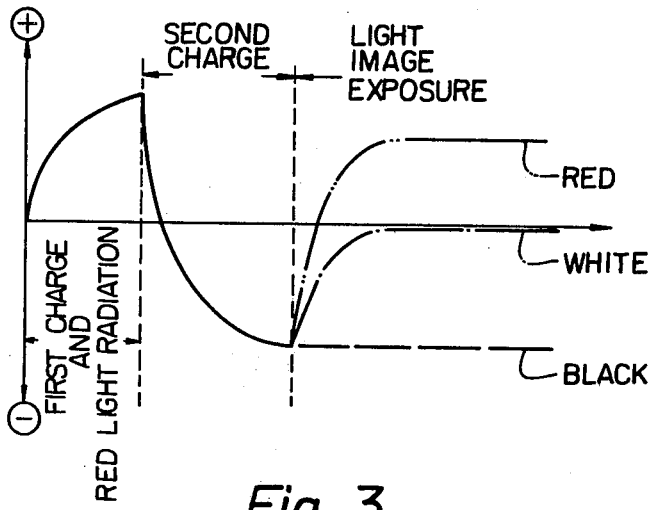
FIG. 2 is a graph illustrating the electrostatic surface potential of a photoconductive member during the various steps of the process of FIGS. 1*a* to 1*d;*

It is important in practicing the process of the present invention that the second charge be smaller in magnitude than the first charge. This is because the second charge (negative) dissipates a portion of the first charge (positive) through neutralization in the red image area in FIG. 1*c*. The positive charge must be sufficiently larger than the negative charge so that sufficient positive charge remains in the layer 11*c* after red light image radiation to form a positive electrostatic image of sufficient magnitude for electrostatography, or more specifically capable of being developed to form a toner image of sufficient density. It is also important that the negative charge at the surface of the member 11 in the black image area be sufficient to form a toner image. In other words, the negative charge must be sufficiently large relative to the positive charge to reverse the potential in the black areas from positive to negative and provide a sufficiently large negative potential for electrostatography. In accordance with the present invention, the magnitudes of positive and negative charges are optimally selected to enable the formation of positive and negative electrostatic images of sufficient magnitude upon exposure to the bicolor light image. FIG. 2 illustrates the surface potential V of the material 11 during the various steps of the process.

Figure 3:
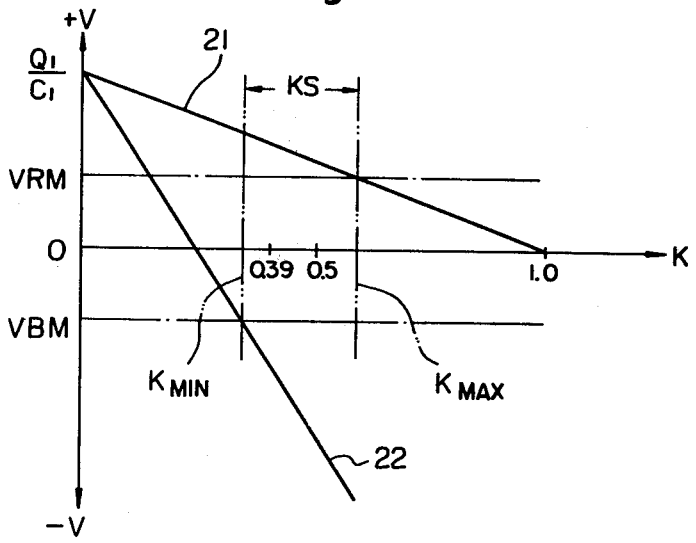
FIG. 3 is a graph illustrating the relationship between the surface potential of a photoconductive member and a ratio of electrostatic charges of photoconductive layers in the process of FIGS. 1*a* to 1*d;*

FIG. 3 illustrates how the capacitances of the layers 11*b* and 11*c* and the magnitudes of the positive and negative charges may be optimally selected to perform the process of the present invention.

The positive charge at the interface of the layers 11*b* and 11*c* is designated as Q1. The negative charge at the surface of the layer 11*c* is designated as Q2. The capacitances of the layers 11*b* and 11*c* are designated as C1 and C2 respectively, per unit area.

Taking a cross section through the material 11 of area ΔS, the charge at the interface of the layers 11*b* and 11*c* is +Q1ΔS and the charge at the surface at the layer 11*c* is −Q2ΔS. Since the substrate 11*a* is grounded, a charge −(Q1−Q2)ΔS is induced at the interface of the substrate 11*a* and layer 11*b*. The capacitances C1 and C2 may be considered as being connected in series. The capacitance C1 stores a charge per unit area of (Q1−Q2). The capacitance C2 stores a charge per unit area of −Q2.

The surface potential VB in the black image area is given as:

$$VB = -Q2\left[\frac{1}{C1} + \frac{1}{C2}\right] + \frac{1}{C2}Q1 \quad (1)$$

The surface potential VR in the red image area is given as:

$$VR = \frac{Q1 - Q2}{C1} \quad (2)$$

Defining a parameter $K = |Q2/Q1|$ and substituting into equations (1) and (2) provides:

$$VB = \frac{Q1}{C1}\left[\left(1 = \frac{C1}{C2} + 1\right) K\right] \quad (3)$$

$$VR = \frac{Q1}{C1}(1 - K) \quad (4)$$

Equation (4) is illustrated as a curve 21 in FIG. 3. Equation (3) is illustrated as a curve 22, where $C2 = \frac{1}{3}C1$. The inclination of the curve 22 depends on the relative values of C1 and C2. Assuming that the minimum values of VR and VB which are sufficient to constitute electrostatic images for electrostatography are designated as VRM and VBM, it will be seen that K has a usable range KS in which VR and VB are both higher than VRM and VBM respectively. In this example, a minimum value KMIN of K is 0.35 and a maximum value KMAX of K is 0.59. VR=VB at K=0.39.

It is further possible within the scope of the invention to make the layer **11*b* panchromatic, or at least sensitive to red light in addition to at least one other color component of white light to which the layer 11*c* is sensitive. In this case, a filter layer which reflects or absorbs red light may be provided between the layers 11*b* and 11*c* so that red light radiated onto the surface of the layer 11*c* is prevented from reaching the layer 11*b*. The same effect may be produced by omitting the filter layer but adding a material to the layer 11*c*** which absorbs red light. A suitable material is a cyanic pigment.

Practical examples of two color electrostatographic process as according to the invention will hereinafter be described.

EXAMPLE 1

A first photoconductive layer was formed on an aluminum substrate by evaporation of selenium of 99.99% purity to a thickness of 10 microns at 45° C. Then a second photoconductive layer was formed on the selenium layer by coating an organic photoconductive composition consisting of a 1:1 mixture of poly-N-vinylcarbazole and 2,4,7-trinitro-9-fluorenon (one molecule of trinitrofluorenon per one monomer of poly-N-vinylcarbazole) to a thickness of 20 microns.

The resultant photoconductive member was subjected to primary charging to a surface potential of +600 V by a 5.5 KV corona discharge during uniform application of red light transmitted through a red filter of a type transmitting light above 640 mm in wavelength (VR-64 filter available from the Toshiba Co. of Japan). This was followed by charging to a surface potential of −900 V in the dark with a −5.7 KV corona discharge.

Thereafter, a light image of an original document having red and black printing on a white background was radiated onto the photoconductive member. The surface potential of the member was −40 V in an area corresponding to the background, −870 V in an area corresponding to the black image and +250 V in an area corresponding to the red image.

The electrostatic image areas corresponding to the black and red areas were developed using a positively charged black toner for use in a UBIX copying machine manufactured by the Konishroku Co. of Japan and a negatively charged experimental red toner prepared by the Ricoh Company, Ltd. of Japan respectively, by magnetic brush type developing units. The toner images thus produced were transferred to an ordinary copy sheet to produce a clear-cut two color copy. The resolution of the black image was found to be as high as 5–7/mm because the corresponding electrostatic image was formed by the negative charge on the surface of the photoconductive member.

EXAMPLE 2

Zinc oxide resin sensitized with Rose bengale was coated on an aluminum substrate to a thickness of 10 microns to form a first photoconductive layer whereupon a 20 micron thick organic photoconductive layer corresponding to the second photoconductive layer prepared in Example 1 was deposited on the first layer. Thereafter, the procedures of Example 1 were repeated with negative primary charging and positive secondary charging. This yielded a clear-cut and high-resolution two color image.

EXAMPLE 3

Bromopyrene sensitized with dinitrofluorenon was coated on an aluminum substrate to form a 7–8 micron thick first photoconductive layer. A second photoconductive layer was thereafter formed by coating bromopyrene sensitized with trinitrofluorenon on the first layer. The same experiment as in Example 1 was conducted on this photoconductive member to obtain a two color image equivalent in sharpness and resolution. This photoconductive member showed no increase in the residual potential thereon even when subjected to repeated copying cycles.

EXAMPLE 4

A photoconductive member was prepared which had an aluminum substrate, and a 20 micron thick second photoconductive layer of Cu-phthalocyanine formed on a 10 micron thick first photoconductive layer of an organic photoconductive material. This member was used for the same experiment as in Example 1 and produced substantially the same results. Although the organic photoconductive layer had a panchromatic spectral sensitivity, it was electrically non-conductive when illuminated with red light since the Cu-phthalocyanine constituting the second layer absorbed red light.

EXAMPLE 5

Example 1 was repeated except that the organic photoconductive layer constituting the second layer was replaced by a 30 micron thick layer of zinc oxide resin sensitized with Rose bengale and methylene Blue (zinc oxide:resin=5:1 by weight). Since the second layer could not be charged to a positive polarity, the primary charging was performed in the dark and the result was substantially the same as that in Example 1.

Using the members of Examples 1–4, black-white images of high resolution could be produced by omitting the first charging, radiating a light image of a black and white document onto the members and developing the resulting monopolar electrostatic images using black toner.

Another two color electrostatographic process embodying the present invention is illustrated in FIGS. **4*a*** to 4*d*. In this process, a photoconductive member or material 31 comprises an electrically conductive, grounded substrate 31*a*. A first photoconductive layer 31*b* is formed on the substrate 31*a* and a second photoconductive layer 31*c* is formed on the first layer 31*b*. The second layer 31*c* may be the same as the layer 11*c* used in the process of FIGS. 1*a* to 1*d*.

The layer 31*b* may be formed of a photoconductive material which is insensitive to red light. Alternatively, the layer 31*b* may be formed of a material sensitive to red light and a substance provided in the layer 31*c* or between the layers 31*b* and 31*c* to block red light and prevent it from reaching the layer 31*b*.

The layer 31*b* is formed of a semiconductive material such as selenium which has a rectifying property such that positive charges (holes) may pass through the layer 31*b* from the substrate 31*a* to the interface between the layers 31*b* and 31*c* but not in the opposite direction in the dark.

Figure 4A:
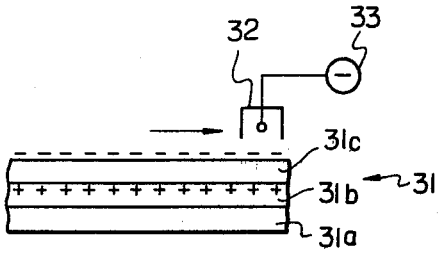
FIG. 4*a* to 4*d* are diagrams illustrating a second electrostatographic process embodying the present invention.

This property of the layer 31*b* allows the red light illumination to be omitted in the first step of the process which is illustrated in FIG. 4*a*. In this case, a corona charger 32 powered by a negative D.C. source 33 applies a negative charge to the surface of the member 11 in the dark. The layer 31*c* does not conduct, so the negative charge remains on the surface of the layer 31*c*.

The negative charge on the surface of the layer 31*c* induces positive charges to migrate or pass from the substrate 31*a* through the layer 31*b* to the interface of the layers 31*b* and 31*c*. Due to the rectifying or semiconductive property of the layer 31*b* described above, the induced positive charge is trapped at the interface of the layers 31*b* and 31*c* since it cannot pass through the layer 31*b* in the opposite direction.

Figure 4B:
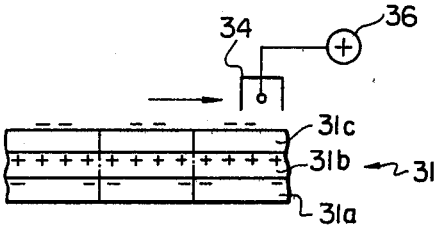

The second step of the process is illustrated in FIG. 4*b* in which a positive charge is applied to the material 31 by a corona charger 34 powered by a positive D.C. source 36. Neither of the layers 31*b* and 31*c* conduct, and the second positive charging has the effect of neutralizing part of the negative charge formed on the surface of the material 31 during the first step. It will be understood that the positive charge remains at the interface of the layers 31*b* and 31*c*. A negative charge equal to the difference between the positive and negative charges is induced at the lower surface of the layer 31*b*.

Figure 5:
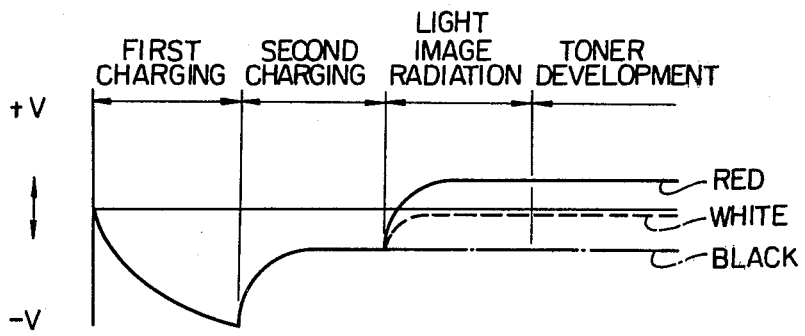
FIG. 5 is a graph illustrating the electrostatic surface potential of a photoconductive member during the various steps of the process of FIGS. 4*a* to 4*d.

As shown in FIG. 5, the magnitude of the positive charge applied in FIG. 4*b* is selected to reduce the negative charge on the surface of the member 31 so that the negative charge is smaller than the positive charge at the interface of the layers 31*b* and 31*c*. The negative charge remaining on the surface of the member 31 after performing the step of FIG. 4*b* corresponds to the second electrostatic charge on the surface of the member 11 in FIG. 1*b*. The positive charge at the interface of the layers 31*b* and 31*c* in FIG. 4*b* corresponds to the first electrostatic charge at the interface of the layers 11*b* and 11*c* in FIG. 1*b*. Although the first and second charges are formed in different, and seemingly opposite ways in the two embodiments of the invention, it will be appreciated that the results are the same.

The magnitude of the second charge is selected so that the surface potential of the member 31 has a large negative value in FIG. 4*a* which is reduced to a smaller negative value in FIG. 4*b*. The negative surface potential of the member 31 in FIG. 4*b* must be large enough to constitute an electrostatic image for electrostatography as in the previous embodiment. Typically, the magnitude of the first electrostatic charge Q1 at the interface of the layers 31*b* and 31*c* and the magnitude of the second electrostatic charge Q2 on the surface of the layer 31*c* in FIG. 4*b* will be comparable to the magnitudes of the first and second electrostatic charges Q1 and Q2 respectively in the embodiment of FIGS. 1*a* to 1*d* after performing the step of FIG. 1*b*.

Figure 4C:
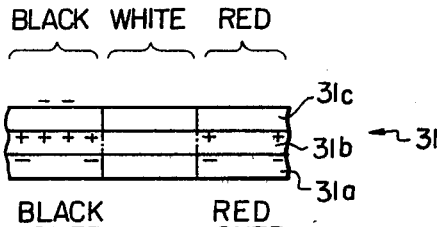
Figure 4D:
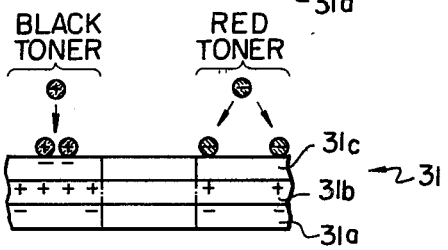

The steps of FIGS. 4*c* and 4*d* are identical to the steps of FIGS. 1*c* and 1*d*. After radiating the member 31 with a color light image in the step of FIG. 4*c*, the electrostatic surface potential in the black area remains negative. Part of the positive charge is neutralized in the red image area through photoconduction of only the layer 31*c*, but the remaining portion of the positive charge causes the surface potential of the member 31 to be reversed from negative to positive. Both layers 31*b* and 31*c* conduct in the white image area to reduce the surface potential to substantially zero.

Figure 6:
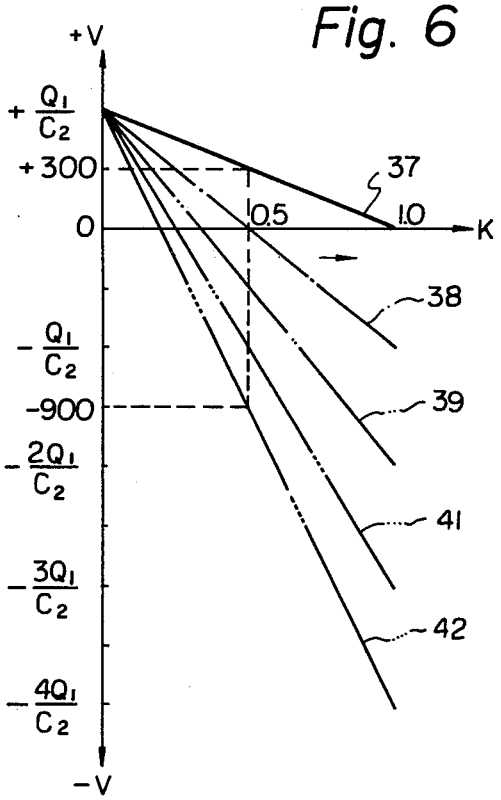
* and FIG. 6 is a graph illustrating the relationship between the surface potential of a photoconductive member and a ratio of electrostatic charges of photoconductive layers in the process of FIGS. 4*a* to 4*d.*

FIG. 6 illustrates the relationship between the capacitances C1 and C2 of the layers 31*b* and 31*c* respectively, the charges Q1 and Q2 and the surface potential in the black and red image areas. A curve 37 represents equation (4), or the red area potential. Curves 38, 39, 41 and 42 represent equation (3), or the black area potential, for values of C2/C1 equal to 1, $\frac{1}{2}$, $\frac{1}{3}$ and $\frac{1}{4}$ respectively. It will be seen from FIG. 6 that it is desirable to make the ratio of C2/C1 small, or to make C2 small in comparison to C1. This has the effect of increasing the negative slope of the curve for the black area potential and increasing the electrostatic contrast between the black and red image areas. Taking the curve 42 as an example, which illustrates the $C2/C1=\frac{1}{4}$, it will be seen that at $K=0.5$, the red area potential is $+300$ V whereas the black image potential is $-900$ V. The electrostatic contrast is therefore $|1200\ V|$, and is higher than can be produced with higher values of C2/C1. Through optimal selection of the values of C1, C2 and K, the values of VR and VB may be made equal or unequal as desired. In the latter case, unequal values of VR and VB may be desirable to compensate for differences in the electrostatic qualities of the black and red toners.

A modification to the embodiment of FIGS. 4*a* to 4*d* is to replace the power source 36 with an A.C. power source (not shown) and thereby apply an alternating corona discharge to the material 31.

The following are practical examples of the embodiment of FIGS. 4*a* to 4*d*.

EXAMPLE 1

A photoconductive member formed of an aluminum substrate, a first photoconductive layer formed by evaporation of selenium of 99.99% purity at 45° C. to a thickness of 10 micron and a 20 micron second photoconductive layer of a 1:1 mixture of poly-N-vinylcarbazole (PVK) and 2,4,7-trinitro-9-fluorenon (TNF). The first photoconductive layer was sensitive to light of all colors except red while the organic second layer had a panchromatic spectral sensitivity. The member was first charged in the dark at $-7.0$ KV to produce a surface potential of $-2400$ V whereafter it was again charged in the dark at $+4.7$ KV to produce a surface potential of $-900$ V. Then, a light image of an original document having a black line area and a red line area on a white background was radiated onto the surface of the member. The surface potential was $-860$ V in the black area, $-40$ V in the white area and $+280$ V in the red area. A clear-cut two color copy was produced by development of the black area and red area with a positively charged black toner and a negatively charged red toner using magnetic brush development. The resolution of the black area was as high as 5–7/mm.

Example 2

A photoconductive member was formed of an aluminum substrate, a first photoconductive layer of zinc oxide resin sensitized with Rose bengale (zinc oxide:resin=3:1 by weight, the resin being KR 214 silicone resin available from Sinetsu Kagaku Co. of Japan) coated to a thickness of 10 micron on the substrate and a second photoconductive layer of the same organic composition used in Example 1 coated to a thickness of 20 micron. The first photoconductive layer was insensitive to red light but sensitive to green light whereas the second layer had a panchromatic light sensitivity. Primary charging was performed in the dark at +6.5 KV to produce a +1800 V of surface potential and, thereafter, secondary charging was effected also in the dark at −4.8 KV to lower the surface potential to +600 V. A light image of the same document used in Example 1 was radiated onto the member, and surface potentials of +580 V, +30 V and −270 V were produced in the black area, white area and red area, respectively. Finally, the black area was developed using a negatively charged black toner and the red area was developed using a positively charged red toner by magnetic brush development. The resultant two color copy favorably featured excellent resolution in the black area.

Example 3

For comparison, an example using the prior basic process mentioned above will be described. A photoconductive member was prepared by evaporating selenium containing 10 Wt% of tellurium on an aluminum substrate to a thickness of 50 micron at 74° C. and then coating the first layer with bromopyrene sensitized with dinitrofluorenon to a thickness of 10 microns. The second photoconductive layer was insensitive to red light while the first photoconductive layer had a panchromatic light sensitivity. The member was charged in the dark to −1200 V and then positively to −800 V in the dark. A light image of the original document used in the above two examples was thereafter radiated onto the surface of the member. The surface potentials measured were +760 V in the black area, −40 V in the white area and −290 V in the red area. When the electrostatic images were developed using a negatively charged black toner and a positively charged red toner, the reproduced black image had a resolution as poor as 3–4/mm.

Example 4

Another photoconductive member applicable to a process of the invention will be discussed hereinafter. The process steps were exactly the same as those in Example 1, and will be described only briefly. The photoconductive member comprised a conductive substrate, an arbitrary first photoconductive layer formed on the substrate and a second photoconductive layer formed on the first layer which was sensitive to and blocked light of a particular color A. The word "arbitrary" means that any kind of material is usable whether or not it is sensitive to the A-color light. Assuming that the color A is red, the member comprised an aluminum substrate, a layer of selenium containing 10 Wt% of tellurium evaporated on the substrate at 74° C. to a thickness of 10 micron and a layer of copper-phthalocyanine coated on the selenium layer to a thickness of 20 micron.

The surface of the photosensitive element was first charged to a predetermined polarity to trap a charge of the opposite polarity therein. The primary charging was followed by secondary charging with the opposite polarity to lower the surface potential of the member. Then, a light image of an original document having black and red areas on a white background was radiated onto the member. In the red image area, the outer or second photoconductive layer sensitive to red light blocked the red light and prevented it from affecting the inner or first layer. However, the second layer conducted with the resultant inversion of the surface potential polarity. In the white background area, white light caused both the inner and outer photoconductive layers to conduct and dissipate charge to make the surface potential substantially zero. In the black image area, the surface potential remained substantially the same as at the end of the secondary charging. After radiation of the image light, the surface potential of the member was the same as in Example 1. The resulting electrostatic image was developed with black and red toner charged to the proper polarities to produce a bicolor copy.

In summary, it will be seen that the present invention provides an improved two color electrostatographic process which produces two color copies of higher quality than is obtainable in the prior art. Various modifications will become possible for those skilled in the art after receiving the teachings of the present disclosure without departing from the scope thereof.

What is claimed is:

1. A two color electrostatographic process comprising the steps of:

(a) providing a photoconductive member having an electrically conductive substrate, a first photoconductive layer formed on the substrate and a second photoconductive layer formed on the first layer, the first and second layers being formed in such a manner that light of a first color radiated onto the second layer renders the first and second layers photoconductive and light of a second color radiated onto the second layer renders only the second layer photoconductive;

(b) forming a first electrostatic charge of a first polarity at an interface between the first and second layers;

(c) forming a second electrostatic charge of a second polarity on the second layer; and (d) radiating a light image onto the second layer, the light image having a black image area and image areas of the first and second colors respectively;

a magnitude of the second charge being smaller than a magnitude of the first charge to an extent such that an electrostatic potential on the second layer is substantially zero in the image area of the first color; of the second polarity and sufficient magnitude to constitute an electrostatic image for electrostatography in the black image area; and of the first polarity and sufficient magnitude to constitute an electrostatic image for electrostatography in the image area of the second color after performing step (d).

2. A process as in claim 1, in which the first color is white.

3. A process as in claim 2, in which the second color is red.

4. A process as in claim 1, in which step (b) comprises simultaneously radiating the second layer with light of the second color and applying the first electrostatic charge thereto.

5. A process as in claim 1, in which the first layer is formed of a semiconductive material allowing passage of charge of the first polarity therethrough only from the substrate to the interface between the first and second layers in the dark, step (b) comprising applying an electrostatic charge of the second polarity to the second layer in the dark causing induced charge of the first polarity to pass from the substrate to the interface between the first and second layers to form the first electrostatic charge; step (c) comprising applying an electrostatic charge of the first polarity to the second layer to partially neutralize the charge of the second polarity applied to the second layer in step (b) and thereby forming the second electrostatic charge.

6. A process as in claim 1, in which steps (a), (b), (c) and (d) further comprise grounding the substrate.

* * * * *